United States Patent [19]

Rudolph et al.

[11] 4,343,241

[45] Aug. 10, 1982

[54] CONTROL DEVICE FOR SUCTION GRIPPER SYSTEMS IN SHEET GUIDING CYLINDERS

[75] Inventors: Otfried Rudolph, Dresden; Gunter Peter, Coswig; Karlheinz Fischer, Coswig; Victor Hefftler, Coswig, all of German Democratic Rep.

[73] Assignee: Veb Kombinat Polygraph "Werner Lamberz" Leipzig, Leipzig, German Democratic Rep.

[21] Appl. No.: 151,112

[22] Filed: May 19, 1980

Related U.S. Application Data

[63] Continuation-in-part of Ser. No. 135,624, Mar. 31, 1980, abandoned.

[30] Foreign Application Priority Data

Apr. 2, 1979 [DD] German Democratic Rep. ... 211939

[51] Int. Cl.[3] ..... B41F 21/06; B65H 5/14

[52] U.S. Cl. ..... 101/231; 101/410; 271/276; 271/196; 271/82

[58] Field of Search ..... 271/82, 277, 276, 194, 271/196, 95; 101/230, 231, 409, 410, 411, 412

[56] References Cited

U.S. PATENT DOCUMENTS

| | | | |
|---|---|---|---|
| 1,775,677 | 9/1930 | Huckins | 271/95 |
| 3,141,667 | 7/1964 | Novick | 271/196 |
| 3,430,946 | 3/1969 | Siebke | 271/277 |
| 3,865,362 | 2/1975 | Luffy et al. | 271/82 |
| 3,992,993 | 11/1976 | Kuhn et al. | 271/82 X |
| 4,018,161 | 4/1977 | Johne et al. | 271/82 X |

*Primary Examiner*—Bruce H. Stoner, Jr.
*Attorney, Agent, or Firm*—Michael J. Striker

[57] ABSTRACT

The control device for a suction gripper on a guiding cylinder of a sheet fed rotary press comprises a tumbler shaft mounted on the sheet guiding cylinder and a suction unit swingable about a pivot point which is supported for movement about the tumbler shaft. The suction unit is either positively driven by a cam drive or self-adjustable by means of a tension spring between the unit and the tumbler shaft.

3 Claims, 4 Drawing Figures

CONTROL DEVICE FOR SUCTION GRIPPER SYSTEMS IN SHEET GUIDING CYLINDERS

CROSS-REFERENCE TO RELATED APPLICATION

This application is a Continuation-in-Part application of our copending application Ser. No. 135,624, filed Mar. 31, 1980, now abandoned, and entitled: DEVICE FOR THE CONTROL OF SUCKER SYSTEMS IN SHEET FEED CYLINDERS.

BACKGROUND OF THE INVENTION

The present invention relates in general to sheet fed presses, and in particular to device for controlling the suction gripper systems arranged in sheet guiding cylinders in face and back printing machines.

In sheet fed face and back printing machines which reverse the sheet about its rear edge and which have only one sheet guiding cylinder between its printing sets, the sheet guiding cylinder is provided with a suction gripper system for engaging the rear edge of the sheet incoming from the upstream impression cylinder and for transferring the sheet to a mechanical gripper system on the subsequent impressions rendered. In order to perform this function the suction gripper system is provided with suitable drives and linkages which generate prescribed movements of the suction unit of the gripper system.

From the DDR Pat. No. 54 703, a suction system is known which is firmly mounted on a tumbler shaft and which is moved on a circular path into a swing-in and swing-out position relative to the movement of the sheet guiding cylinder.

The disadvantage of this known control device for the suction gripper system is the fact that a so-called deviation angle is formed between the upper surface of the suction head and the sheet to be disengaged from the impression cylinder during the swing-in movement of the suction gripper system when the sheet is to be transferred to the gripper system of the sheet guiding cylinder. As a result of this deviation angle, the holding force of the suction system diminishes and particularly in processing carton-like papers misplacements of the sheet from the suction head and the buckling of the sheet portion immediately adjoining the engagement surface with the suction gripper may occur.

This disadvantage takes effect especially in the case of increased pulling forces employed at higher working speeds of the printing machine and consequently orientation and registration failures may result. In the DDR Pat. No. 110 451 a suction gripper system is disclosed which is a part of a coupling member between a double rocker arm and consequently is guided on a curved path of movement of the coupling member. Due to the formation of a bulge on the sheet the pulling forces exerted by the suction gripper system are temporarily reduced. Nonetheless the problem of the aforementioned deviation angle is not solved by this prior art suction gripper control and this angle is formed similarly as in the other known suction systems. Moreover the arrangement of a suction gripper on a coupling member results in high construction expenditures.

SUMMARY OF THE INVENTION

It is therefore a general object of the present invention to overcome the aforementioned disadvantages. More particularly, it is an object of the invention to provide an improved control device for the suction gripper system on sheet guiding cylinders which avoids the orientation and registration failures.

Another object of this invention is to provide such an improved suction gripper control system which prevents the formation of wrinkles during the reversal of the sheet.

An additional object of the invention is to provide such an improved system in which the deviation angle between the sheet and the suction surface is avoided and consequently an increased holding force of the suction gripper is attained.

A further object of the invention is to provide a gripper control system which makes it possible to process all sorts of paper sheets at high rotary speeds of the printing machine.

In keeping with these objects and others which will become apparent hereafter, one feature of the invention resides, in a control device for a suction gripper system which is arranged in a guiding cylinder of a sheet fed, face and back printing machine having at least two impression cylinders with the sheet guiding cylinder arranged therebetween, in the provision of a tumbler shaft mounted on the guiding cylinder, a suction gripper unit swingable about a pivot point which is supported for movement about the shaft to take over a sheet from the upstream impression cylinder.

The movement of the suction gripper unit is thus controlled by the movement of the shaft and in addition is controlled by a cam drive. The cam drive has a cam which may be arranged either concentrically or eccentrically relative to the tumbler shaft.

According to another embodiment of the suction gripper unit of this invention, means are provided for an automatic adjustment of the pulling force exerted against the sheet in the desired direction. In this embodiment the automatically adjustable suction gripper unit has a lever provided with a stop for limiting the tilting movement of the gripper.

The supply of suction air for the suction gripper unit is effected through the tumbler shaft carriage in the form of a hollow shaft connected to the suction gripper by a flexible hose connection or via a separate pipe arranged parallel to the tumbler shaft. The suction air supply in the latter case is also effected by the flexible hose connection.

The tilting movability of the suction unit which insures a zero or an almost zero deviation angle between the sheet and the suction surface results in an increased holding force of the whole suction system. As a consequence, even at high operational speeds of the press, carton or carton-like papers can be processed without any auxiliary devices.

The swing-in movement of the suction gripper system now takes place without the formation of the aforementioned deviation angle and therefore the acceleration of the system can be optimized.

The novel features which are considered as characteristic for the invention are set forth in particular in the appended claims. The invention itself, however, both as to its construction and to its method of operation, together with additional objects and advantages thereof, will be best understood from the following description of specific embodiments when read in connection with the accompanying drawing.

DESCRIPTION OF THE PREFERRED EMBODIMENTS

Figure 1:
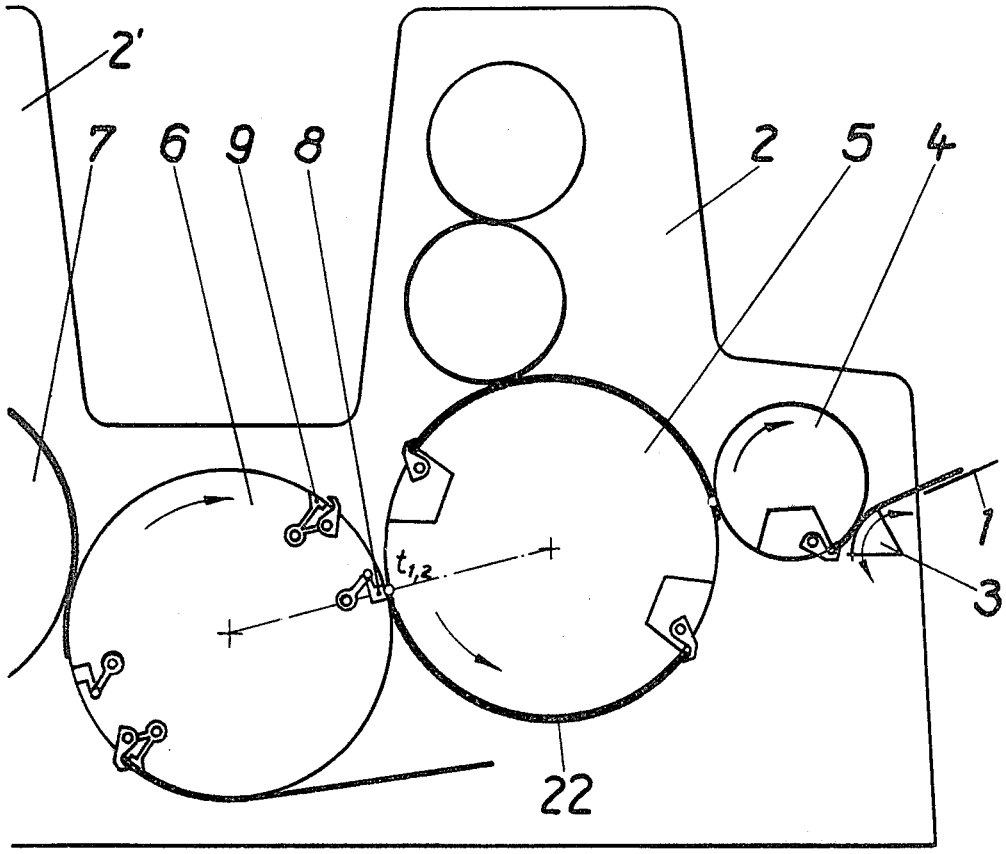
FIG. 1 is a schematic side view of a sheet-fed multicolor rotary press including a sheet guiding cylinder.

Referring firstly to FIG. 1, there is illustrated a multicolor sheet-fed rotary press composed of a first printing set 2 including a first impression cylinder 5 and a second printing set 2' with a second impression cylinder 7. The first impression cylinder 5 cooperates with sheet feeding means having a feed cylinder 4, feed table and an auxiliary gripper system 3. A sheet guiding cylinder 6 provided with clamping gripper system 9 and a suction gripper system 8 of this invention is arranged between the first and the second impression cylinders 5 and 7.

The drive of the suction and clamping gripper systems 8 and 9 is made by conventional driving means which need not be described in detail.

Figure 2:
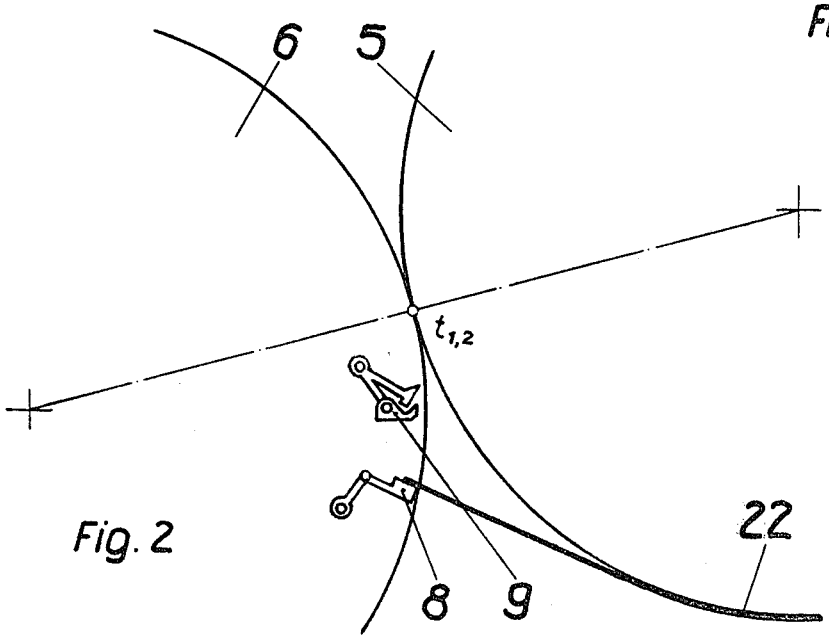
FIG. 2 illustrates a turn-over phase of a sheet by means of a suction gripper of this invention.

FIG. 2 shows the position of a sheet between the first impression cylinder 5 and the sheet guiding cylinder 6 during the sheet reversing phase.

Figure 3:
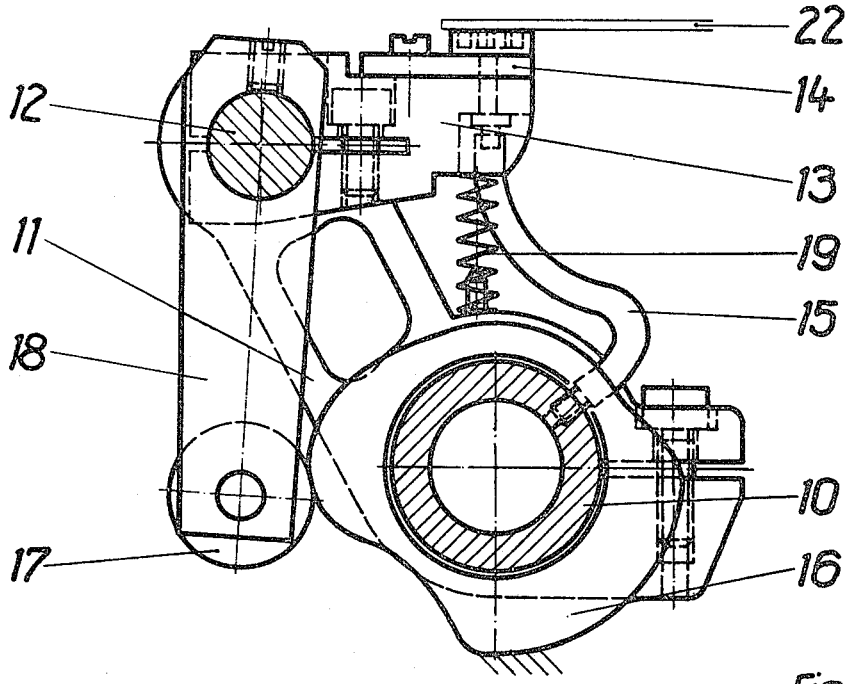
FIG. 3 is a side view of a suction rocker having a positive control of its suction unit.

FIG. 3 shows the suction gripper system 8 of this invention which is supported on a tumbler shaft 10 arranged in the sheet guiding cylinder 6. The suction gripper system 8 includes a support arm 11 secured to tumbler shaft 10 and being provided on its free end with bearing on which rests a pin or journal 12. The journal 12 is firmly connected to an arm 13 which supports a suction head 14. The suction head 14 is connected to a source of suction air by means of a flexible hose connection 15. In this manner, the suction unit formed by the journal 12, the arm 13 and the suction head 14 is pivotable in the bearing at the end of the rotatable support arm 11. The suction gripper system 8 further includes a cam drive formed by a cam disc 16 rotatable about the shaft 10, a cam follower 17 and a cam follower lever 18. The lever 18 is fixedly mounted on the journal 12 and a pressure spring 19 between the support arm 11 and the suction head arm 13 urges the cam follower 17 against the cam surface of the cam disc 16. In this embodiment, the cam disc 16 is secured to the sheet guiding cylinder 6 and rotates about the center axis of the tumbler shaft 10. The tumbler shaft is in the form of a hollow shaft communicating with an non-illustrated source of suction air and is provided with an outlet port hermetically connected to the flexible hose connection 15. It will be noted that in a modification it is possible to arrange the cam disc 16 apart from the shaft 10.

Figure 4:
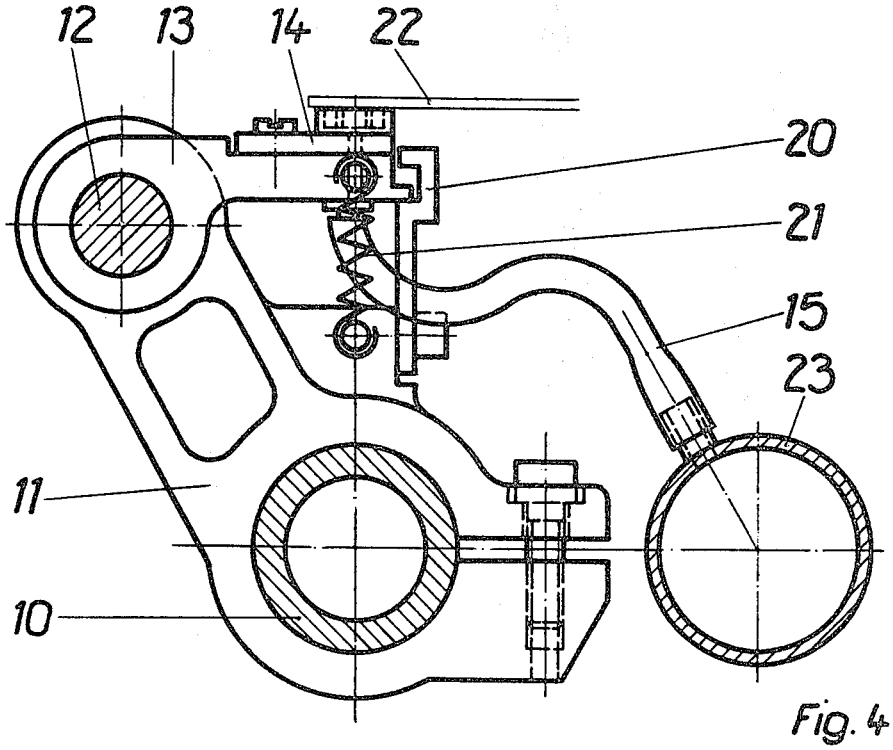
FIG. 4 is a suction rocker of this invention having an automatically adjustable suction unit.

FIG. 4 illustrates the suction gripper system 8 having an automatically adjustable suction unit 13 and 14. In this embodiment the rotatable support arm 11 is provided with a stop member 20 cooperating with a projection at the end of the suction head arm 13 to limit its tilting movement. In addition, a tension spring 21 between the arms 11 and 13 biases the suction unit 13 and 14 into a lower end position on the stop member 20. In this embodiment, the flexible hose connection 15 connects the suction head 14 to a separate pipe 23 connected to the source of suction air via an non-illustrated control valve of a conventional design. The suction pipe 23 extends in parallel with the tumbler shaft 10.

The operation of the suction gripper control device 8 of this invention is as follows:

A sheet 22 is fed in a known manner from a feed table 1 by means of preliminary grippers 3 and a feed cylinder 4 to an impression cylinder 5 of the first printing set 2 and upon its printing on one face the rear edge of the sheet is engaged at tangential point $t_{1,2}$ by the suction gripper system 8 and transferred to the clamping gripper system 9 which again transfers the sheet to the second impression cylinder 7.

During the rotation of the sheet guiding cylinder 6 the suction system 8 is controlled by a non-illustrated rocking drive performing a periodic rocking movement. In addition to this rocking movement, as illustrated in FIG. 3, the cam drive 16, 17 and 18 imparts to the suction gripper unit 13 and 14 a tilting movement corresponding to the shape of the cam disc 16. As a consequence, the suction unit 13 and 14 in the phase of a sheet takeover is positively driven into a position in which the suction surface of the head 14 accurately or almost accurately coincides with the sheet 22 on the upstream impression cylinder 5 (FIG. 2). The automatic control of the suction gripper system 8 according to the embodiment of FIG. 4 results from the fact that the suction unit 13 and 14 responds to the effective direction of the pulling force between the suction head and the sheet during the withdrawal of the latter from the upstream impression cylinder and turns against the force of tension spring 21 toward the upper stop limit of the member 20. The stop member 20 thus limits the tilting angle of the suction gripper unit 13 and 14 and insures that during the sheet transfer operation the suction gripper system 8 takes over the sheet at the tangential point $t_{1.2}$ and that the transfer of the sheet from the suction gripper system 8 to the clamping gripper system 9 in the sheet guiding cylinder 6 takes place in an exact and adjustable position of the processed sheet.

The tilting point of the suction gripper unit 13 and 14 represented by the journal 12 showed in this embodiment be arranged closer to the periphery of the sheet guiding cylinder 6 than in the preceding example.

It will be understood that each of the elements discussed above or two or more together may also find a useful application in other types of construction differing from the type described above.

While the invention has been illustrated and described as embodied in a suction gripper system for use with multicolor sheet fed rotary presses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. A control device for a suction gripper system arranged on guiding cylinders of a sheet fed, face and back printing machine having at least two impression cylinders and at least one sheet guiding cylinder situated therebetween, the gripper system being operative for reversing a sheet about its rear edge, the device comprising a tumbler shaft mounted in the sheet guiding cylinder; a suction unit including a suction head cooperating with a sheet being processed and a suction arm supporting said suction head and mounted on a pivot having a pivot point, and a support arm secured to said tumbler shaft and having a free end supported on said pivot, said pivot being spaced from said tumbler shaft, said suction arm being arranged for swingable movement about said pivot point so that the position of said suction head relative to a sheet being processed is controlled so that a sheet is taken over from the cooperating impression cylinder at a minimum deviation angle, said support arm being spring biased by a tension spring mounted between said support arm and said suction arm to provide for a self-adjustment of the swingable movement of said suction arm.

2. A device as defined in claim 1 further including a separate pipe for supplying suction air, said pipe being arranged in parallel with said tumbler shaft and being connected to said suction unit by a flexible hose connection.

3. A device as defined in claim 1, further including a stop member mounted on said tumbler shaft and cooperating with said suction unit to limit its tilting movement.

* * * * *